United States Patent [19]

Everswick

[11] 4,119,913

[45] Oct. 10, 1978

[54] PROJECTILE IN-BORE MEMORY SYSTEM

[75] Inventor: David N. Everswick, Succasunna, N.J.

[73] Assignee: The United States of America as represented by the Secretary of the Army, Washington, D.C.

[21] Appl. No.: 817,304

[22] Filed: Jul. 20, 1977

[51] Int. Cl.[2] ..... H04B 1/02

[52] U.S. Cl. ..... 325/113; 325/115; 340/208

[58] Field of Search ..... 325/111, 113, 114, 115; 340/207 R, 208, 209, 224; 244/3.14, 3.19; 73/167

[56] References Cited

U.S. PATENT DOCUMENTS

| | | | |
|---|---|---|---|
| 2,877,452 | 3/1959 | Astin | 325/115 |
| 2,900,607 | 8/1959 | Barabutes et al. | 340/208 |
| 3,035,228 | 5/1962 | Ratz | 340/208 |
| 3,623,045 | 11/1971 | Ouellette | 340/207 R |
| 4,040,059 | 8/1977 | Simmons et al. | 325/113 |

*Primary Examiner*—Robert L. Griffin
*Assistant Examiner*—Jin F. Ng
*Attorney, Agent, or Firm*—Nathan Edelberg; A. Victor Erkkila; Max Yarmovsky

[57] ABSTRACT

A single channel telemetry circuit is used to measure the in-bore environmental experiences encountered by a projectile and to delay transmission of the data gathered until the projectile is clear of the gun and at a time when a transmission link between an on board transmitter and a ground based telemetry receiving station has been optimized.

4 Claims, 4 Drawing Figures

PROJECTILE IN-BORE MEMORY SYSTEM

GOVERNMENTAL INTEREST

The invention described herein may be manufactured, used and licensed by or for the Government for governmental purposes without the payment to me of any royalty thereon.

BACKGROUND OF THE INVENTION

Various means have been used in the past to acquire accurate data regarding a shell's in-bore environmental experiences in order to decrease the frequency of in-bore malfunctions and prevent either unnecessary rejections of munitions or the production of overdesigned munitions. One of the problems with prior art devices which used hard wiring from the projectile transducers up the gun tube to recording equipment was that it was practical only for lower zone firing tests. When the aforementioned prior art devices were used for high zone firings, the higher stress forces invariably resulted in wire breaks and consequently loss of test data. In addition, because of wire breakage the test data of the induced strain, caused by the stress environment that a shell experiences when exiting from the gun tube, could not be measured. Other prior art devices utilize R.F. transmission of in-bore shell strain measuring transducers to transmit test data to out of gun tube recording equipment. The problem generally found with this technique was the effect of the gun tube acting as a wave guide. The wave guide effect would frequently short out the R.F. test data signal at various points in the gun tube as the transmitting elements of the projectile traveled up the tube. In addition, blow-by-gases seeping around the shell usually caused further alteration of the R.F. test signal. This shorting and alteration effect on the transmitted R.F. signal was particularly noticeable in worn gun tubes. As a result of the aforementioned problems only limited test data coverage was possible and frequently the information transmitted on this limited signal was made additionally uncertain because of a noisy signal. Other prior art devices have used laser devices to transmit in-bore test data out of the gun tube to recording equipment. The major difficulty with the use of this technique was the critical alignment requirements of the transmitter and its receiving station. In addition blow-by gases leaking around the projectile as it traveled up the gun tube usually obscured and attenuated the laser light beam and resulted in further data loss.

In the past digital delaying techniques have been used on missile programs to delay transmission of data until R.F. transmission conditions were optimized. However, the prior art delay techniques required that the data be first sampled and digitized by use of an analog to digital converter and then by using digital shift registers delay the data transmission an appropriate amount. The data then had to be reconstructed by use of a digital to analog converter. This prior art technique of delaying data has been found to be costly, complex, and too large to be effectively utilized in in-bore projectile telemetry requirements.

SUMMARY OF THE INVENTION

The present invention relates to an in-bore projectile memory system which eliminates the need to digitize the in-bore transmitted test data, the need for digital converters, digital shift registers, and digital to analog converter circuitry. The present invention is a cost effective, miniaturized, reliable means for obtaining in-bore telemetry data on gun fired projectiles. Data acquisition in the present device begins prior to firing of the projectile and continues until the projectile exits the gun tube, thus providing a continuous measurement of the total in-bore stress environment that a projectile experiences immediately during and after launch.

An object of the present invention is to provide reliable in-bore data on projectile environment which utilizes a system not dependent on critical alignment of transmitter and reciever.

Another object of the present invention is to provide a projectile in-bore memory system which is unaffected by blow-by gas seepage and expelling projectile gases.

Another object of the present invention is to insure a projectile in-bore memory transmitting system which is durable and "G" hardened through the use of solid state components capable of withstanding field stress environments.

Another object of the present invention is to provide a projectile in-bore memory system having miniaturized components to enable in-bore testing of all munitions having diameters of 60 millimeters and greater.

Another object of the present invention is to provide an in-bore memory system which furnishes complete in-bore test data covering the entire time that a projectile dwells within the gun tube.

A further object of the present invention is to provide an in-bore memory system which eliminates the need to digitize in-bore telemetry data and thus eliminates the need for a memory system which utilizes an analog to digital converter, digital shift registers, and digital to analog converters.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawings.

DESCRIPTION OF THE PREFERRED EMBODIMENTS

Figure 1:
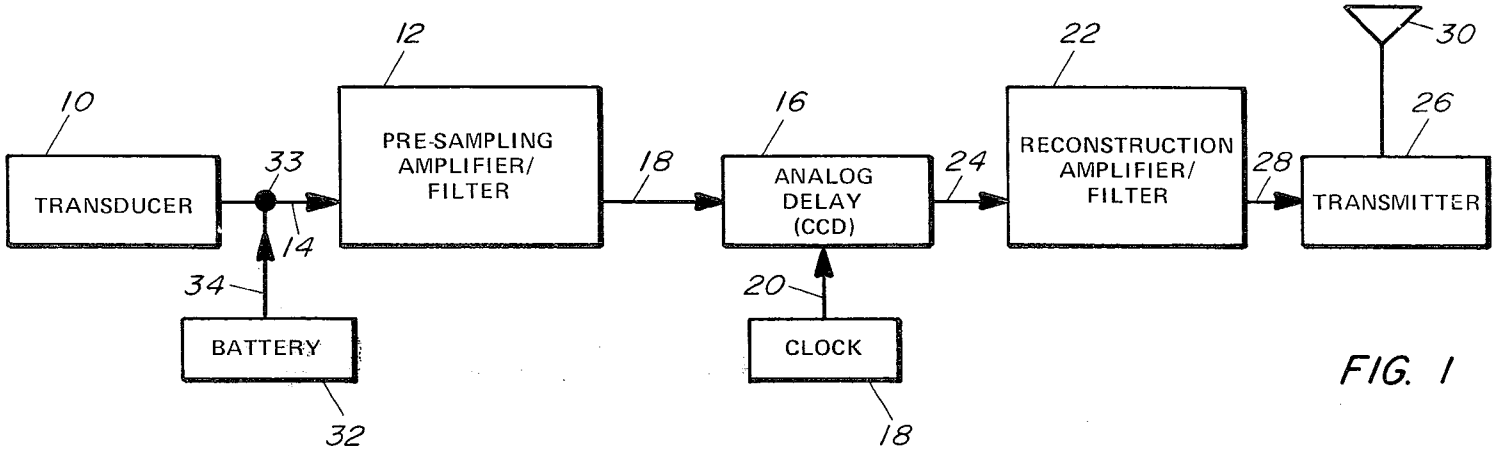
FIG. 1 is a schematic block diagram of a single channel telemetry system used to measure in-bore test data on a projectile.

Referring now to FIG. 1 a transducer accelerometer 10, such as Model No. 1106 manufuctured by Columbia Research Corporation of Woodlyn, Pa., is fixedly mounted in a projectile to sense the stress environment that a projectile is subjected to when being launched and for generating a voltage signal in response thereto. The parameter being measured by the accelerometer may be caused by acceleration, vibration, shock and/or pressure. The output of transducer 10, which may include a temperature sensing element, is electrically coupled to the input of a pre-sampling amplifier filter 12 via electrical conductor 14. A pre-sampling amplifier/filter such as Model XR-4202 manufactured by Exar Integrated Systems Corp., of Sunnyvale, Calif. is suitable for use in this application. The pre-sampling amplifier/-filter 12 is utilized to amplify the transducer 10 signal and filter out the unwanted high frequency components which are present at the transducer output. The amplifier/filter 12 utilizes a low pass filter to pass the frequency components of interest contained in the transducer output signal and to filter out the unwanted high frequency components and noise. Without the use of this low pass filter an aliasing error would be generated on the data. The filtered and amplified output signal from the pre-sampling amplifier/filter 12 is electrically coupled to an analog delay circuit 16 via electrical conductor 18. The analog delay 16 utilizes a charge coupled device, such as Model SAD-1024 manufactured by Reticon Corp., of Sunnyvale, Cal., to sample and store the data generated by the transducer 12. A clock circuit 18 utilizing logic control circuit elements such as a complementary metal oxide semiconductor (COMOS) device Model CD 4013 in conjunction with a dual D type flip-flop, and an astable multivibrator CMOS 4047 manufactured by RCA of Somerville, N.J., is used to develop a signal electrical conductor 20 to drive the analog delay 16. The frequency of the clock 18 is set to be greater than twice the roll-off frequency of the filter. The output signal of analog delay 16 is coupled to a reconstruction amplifier/filter 22 via electrical conductor 24. A low power operational amplifier such as Exar Corp., model XR 4202 is used to amplify and reconstruct the amplified filtered signal fed by the analog delay 16. The reconstruction amplifier/filter 22 converts the discrete analog pulses into a continuous waveform. The amplified output signal of the reconstruction amplifier/filter 22 is fed into a transmitter 26 via electrical conductor 28. The transmitter 26 is a general purpose type such as Model T-4X0, manufactured by Microcom Corp., of Warminster, Pa. An output signal of the transmitter 26 is generated in response to the output of the reconstruction amplifier/filter 22 and delivered to a suitable telemetry sensing antenna 30 such as Model AN-12 manufactured by Ball Brothers of Boulder, Colo. A nickel-cadmium battery 32 is connected to the telemetry transmitting circuit of FIG. 1 at junction point 33 and provides power thereto via electrical conductor 34.

Figure 2:
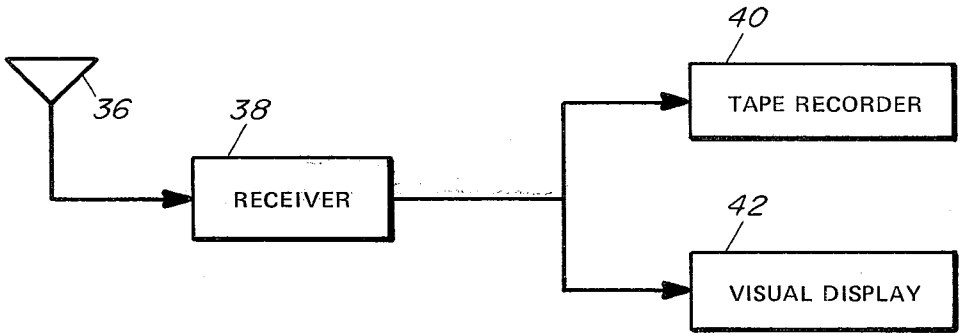
FIG. 2 is a schematic block diagram of a standard telemetry ground receiving station.

Referring now to FIG. 2, a ground based telemetry station is used to recieve the R.F. signals transmitted from antenna 30. The receiving ground based station comprises a receiving antenna 36 connected to the input of a receiver 38. The output of the receiver 38 may be connected either to a tape recorder 40 or to a visual display device 42 such as an oscillograph, or to both as shown in FIG. 2.

Figure 3:
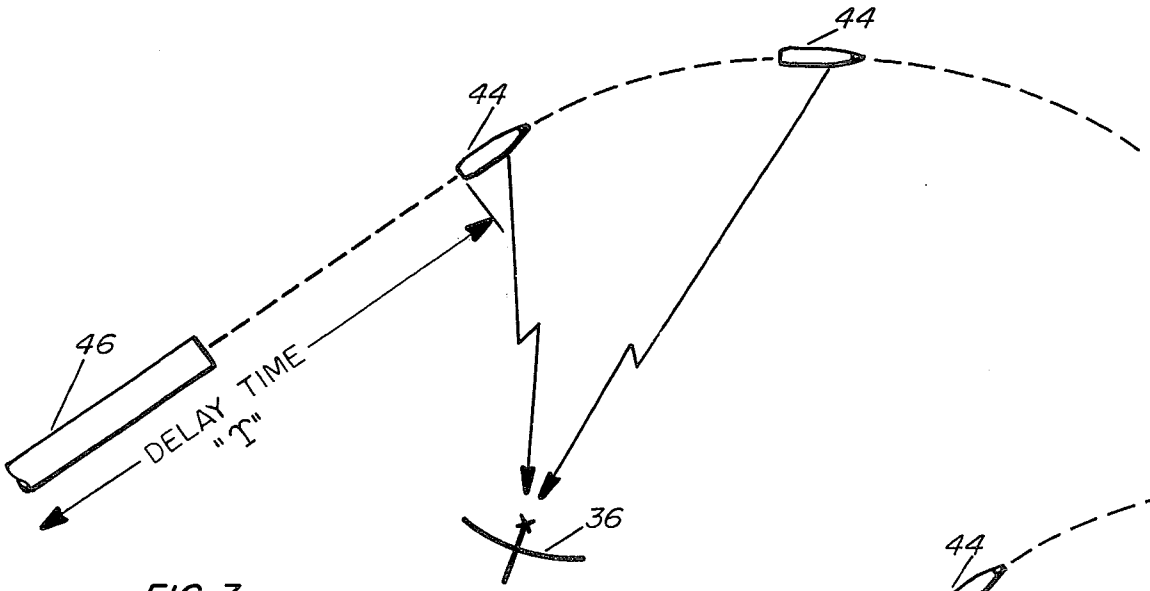
FIG. 3 is an elevational diagrammatic view illustrating how the in-bore data transmission is delayed until the transmission link between a transmitting projectile and receiving station antenna is optimized.

FIG. 3 shows diagrammatically the ejection of a projectile 44 from a launch weapon 46, which contains a telemetry transmitting memory system aforedescribed. The in-bore data transmission is delayed for a delay time "$\Upsilon$" until the transmission link to receiving antenna 36 is optimized. Because of the short path length (10–15 feet) between the projectile 44 and the receiving antenna 36 the power requirements of transmitter 26 are greatly reduced, the system efficiency is improved, and consequently the size of the batteries carried by the transmitting system may be reduced to meet the smaller power needs. The relatively low power requirements of the in-bore memory system contributes to the design of a miniaturized package capable of being contained within a projectile having a diameter as small as 60 millimeters.

Figure 4:
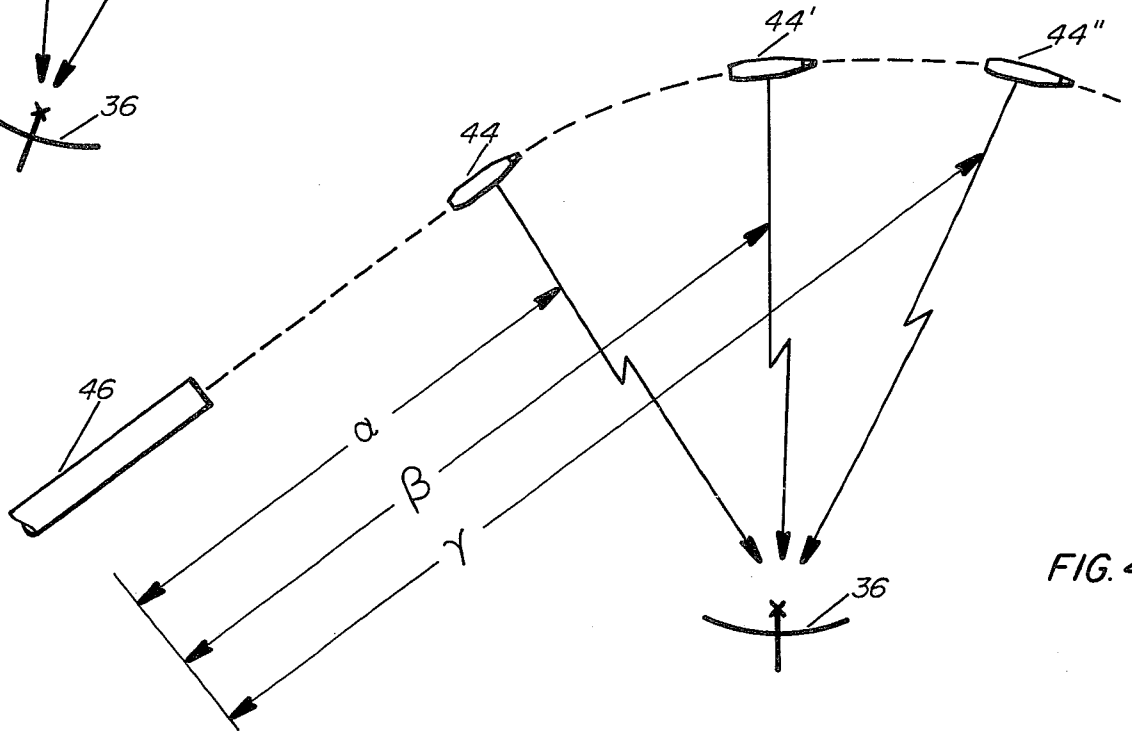
FIG. 4 is an elevational diagrammatic view illustrating a redundant three element delay transmission link between a transmitting projectile and a ground based receiving station.

Referring now to FIG. 4 the aforementioned system shown in FIGS. 1–3 can be modified to include additional delay means into the circuitry of FIG. 1 to provide for a plurality of redundant transmissions of in-bore data during the projectile's free flight trajectory. A three delay transmission situation is illustrated in FIG. 4. The first transmission of the in-bore data occurs at the end of delay represented by distance $\alpha$. A second and third redundant transmission of the in-bore data occurs at the end of delays represented by distances $\beta$ and $\gamma$ when the projectile 44, and 44'' are located only short distances down range, but still well within the receiving antenna's 36 optimum pickup range.

In operation, the environment or function to be monitored in projectile 44 is sensed by the transducer 10. The transducer output is fed to the input of the pre-sampling amplifier/filter circuit 12 and conditioned thereby to pass frequency components of interest and to filter out unwanted high frequency components of the test signal and random noise signals. The conditioned output signal of the pre-sampling amplifier/filter 12 is applied to the input of analog delay circuit 16. A clock circuit 18 generates output signals having a frequency and pulse duration sufficient to permit reconstruction of the highest signal frequency of interest, and of sufficient amplitude to drive the analog delay 16. The duration of the analog delay 16 is determined by the time delay "$\Upsilon$" desired as previously described. The in-bore environmental delayed test data in the form of discrete analog pulses is then fed to the reconstruction amplifier/filter circuit 22 where these discrete analog pulses are converted into a continuous waveform which is then fed thru a transmitter 26 to the transmitter antenna 30 which in turn beams the telemetry in-bore signal to the antenna of the ground receiving station 36 as shown in FIG. 2.

While a single channel telemetry memory system has been shown in FIG. 1, it should be understood that a multi-channel telemetry system could be used and would include a plurality of tranducer elements with associated pre-sampling amplifier/filters, analog delays and reconstruction amplifier/filters electrically coupled to a common transmitter 26. This multi-channel in-bore telemetry system would measure simultaneously previously mentioned stress producing environments such as tri-axial acceleration, shock, vibration, temperature, propellant gas pressure, and other strain producing forces which would be of interest to a munitions designer.

While there has be described and illustrated specific embodiments of the invention, it will be obvious that various changes, modifications and additions can be made herein without departing from the field of the invention which should be limited only the the scope of the appended claims.

Having thus fully described the invention, what is claimed as new and desired to be secured by Letters Patent of the United States is:

1. A projectile in-bore memory system for transmitting telemetry environmental data to a ground based telemetry receiving station which comprises:

transducer means operatively disposed in said projectile for sensing in-bore stress environment on said projectile and for generating a transducer output voltage signal in response thereto;

pre-sampling amplifier/filter means having an input electrically coupled to said transducer means for amplifying said transducer output voltage signals of interest and for filtering out unwanted high frequency components contained in said transducer output voltage signal and noise signals generated by said transducer means;

analog delay means electrically coupled to the output of said pre-sampling amplifier filter means for generating and storing discrete analog pulses in response to the output from said pre-sampling amplifier filter means, said analog delay means including means for delaying the generation of the analog pulses for a time "ϒ";

reconstruction amplifier/filter means electrically coupled to the output of said analog delay means for amplifying and reconstructing said transducer output voltage signal; and transmitter means electrically coupled to the output of said reconstruction amplifier/filter means for generating an electromagnetic signal in response thereto after said time delay "ϒ", said signal having sufficient amplitude to be detected by said ground based telemetry receiving station.

2. A projectile in-bore memory system as recited in claim 1 wherein said transducer means comprises an accelerometer operatively disposed within said projectile for measuring stress forces imposed thereon due to vibration, shock or pressure during projectile launch.

3. A projectile in-bore memory system as recited in claim 2 wherein said analog delay means further includes clock circuit means for developing signals to drive said analog delay means after said delay time "ϒ".

4. A projectile in-bore memory system as recited in claim 3 wherein said reconstruction amplifier/filter means includes filter means for converting said discrete analog pulses into a continous analog waveform.

* * * * *